US009725819B2

(12) United States Patent
Runge et al.

(10) Patent No.: US 9,725,819 B2
(45) Date of Patent: Aug. 8, 2017

(54) METHODS FOR INCORPORATING ULTRAVIOLET LIGHT ABSORBING COMPOUNDS INTO ANODIC OXIDES

(71) Applicant: Apple Inc., Cupertino, CA (US)

(72) Inventors: Jude Mary Runge, Chicago, IL (US); Patrick S. Wieler, Brampton (CA); John Murray Thornton, III, Los Gatos, CA (US); Max A. Maloney, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/161,482

(22) Filed: Jan. 22, 2014

(65) Prior Publication Data

US 2015/0093563 A1 Apr. 2, 2015

Related U.S. Application Data

(60) Provisional application No. 61/884,911, filed on Sep. 30, 2013.

(51) Int. Cl.

| | |
|---|---|
| ***C25D 11/02*** | (2006.01) |
| ***C25D 11/24*** | (2006.01) |
| ***C25D 11/26*** | (2006.01) |
| ***C25D 11/30*** | (2006.01) |
| ***C25D 11/34*** | (2006.01) |

(52) U.S. Cl.

CPC ..... *C25D 11/243* (2013.01); *C25D 11/246* (2013.01); *C25D 11/26* (2013.01); *C25D 11/30* (2013.01); *C25D 11/34* (2013.01); *Y10T 428/24997* (2015.04)

(58) Field of Classification Search

None

See application file for complete search history.

(56) References Cited

U.S. PATENT DOCUMENTS

| | | | | |
|---|---|---|---|---|
| 4,030,482 | A * | 6/1977 | Navato | 374/162 |
| 5,401,337 | A * | 3/1995 | Carlson et al. | 148/257 |
| 6,821,305 | B2 | 11/2004 | Yan | |
| 8,057,858 | B2 | 11/2011 | Dierdorf et al. | |

(Continued)

FOREIGN PATENT DOCUMENTS

WO WO 2005014894 2/2005

OTHER PUBLICATIONS

Liu et.al. Electrochimica Acta, 2011, 4595-4602.*

Charles A. Grubbs. Metal Finishing. vol. 99, Supplement 1, Jan. 2001, 478-493.*

*Primary Examiner* — Vera Katz

(74) *Attorney, Agent, or Firm* — Downey Brand, LLP

(57) ABSTRACT

The embodiments described herein relate to anodic oxides and methods for forming anodic oxides. The methods involve incorporating an ultraviolet (UV) light absorbing compounds into anodic oxides to prevent color fading of the anodic oxides caused by exposure to UV light. In some embodiments, the UV light absorbing compound includes para-aminobenzoic acid (PABA). The UV light absorbing compound can be incorporated within the anodic oxide during a sealing process. The UV light absorbing compound becomes infused within a seal layer, which is formed during the sealing process. The resultant anodic oxide has a UV light absorbing seal layer that can block UV light from reaching any underlying colorant existing within the anodic oxide.

13 Claims, 8 Drawing Sheets

(56) References Cited

U.S. PATENT DOCUMENTS

| | | | | |
|---|---|---|---|---|
| 2004/0000490 | A1 | 1/2004 | Chang | |
| 2006/0260947 | A1 | 11/2006 | Kia et al. | |
| 2007/0051275 | A1 | 3/2007 | Muller et al. | |
| 2008/0149492 | A1* | 6/2008 | Lin et al. | 205/206 |
| 2009/0067874 | A1* | 3/2009 | Hoshio | 399/100 |

* cited by examiner

METHODS FOR INCORPORATING ULTRAVIOLET LIGHT ABSORBING COMPOUNDS INTO ANODIC OXIDES

CROSS-REFERENCE TO RELATED APPLICATIONS

This application claims priority to U.S. Provisional Application No. 61/884,911 filed Sep. 30, 2013 entitled "METHODS FOR INCORPORATING ULTRAVIOLET LIGHT ABSORBING COMPOUNDS INTO ANODIC OXIDES," which is incorporated herein by reference in its entirety.

FIELD

This disclosure relates generally to anodic oxides. More specifically, methods for incorporating ultraviolet light (UV) light absorbing compounds into anodic oxides are disclosed.

BACKGROUND

Anodizing is an electrolytic oxidative process used to increase the thickness of a natural passive layer on a surface of a metal part, where the part to be treated forms the anode electrode of an electrical circuit. The resultant metal oxide film, referred to as an anodic oxide, increases the corrosion resistance and wear resistance of the surface of the metal part. Anodic oxides can also be used for a number of cosmetic effects. For example, techniques for colorizing anodic oxides have been developed that can provide an anodic oxide with a perceived color. In many cases, colorants such as dyes are added within pores of the anodic oxide to give the anodic oxide particular colors. However, with exposure to ultraviolet (UV) light, the color of the anodic oxides can fade from their original color.

SUMMARY

According to one embodiment, a method for preparing a color fade resistant anodic oxide is described. The anodic oxide has a colorant deposited within pores of the anodic oxide. The method includes incorporating an ultraviolet (UV) light absorbing compound into the anodic oxide by exposing the anodic oxide to a solution containing the UV light absorbing compound. The UV light absorbing compound is configured to absorb at least a portion of UV wavelengths of light. The incorporated UV light absorbing compound blocks at least a portion of UV tight incident a top surface of the anodic oxide from reaching the colorant.

According to another embodiment, a part is described. The part includes a substrate. The part also includes a color fade resistant anodic oxide layer disposed over the substrate. The color fade resistant oxide layer has a number of pores. The color fade resistant oxide layer includes an ultraviolet (UV) light absorbing layer having a UV light absorbing compound infused therein. The UV light absorbing compound is configured to absorb at least a portion of UV wavelengths of light. The color fade resistant oxide layer also includes a colorant deposited with the pores of the anodic oxide. The infused UV light absorbing compound blocks at least a portion of UV light incident a top surface of the anodic oxide from reaching the colorant.

According to a further embodiment, a method for preparing a color fade resistant anodic oxide is described. The anodic oxide has a colorant deposited within pores of the anodic oxide. The method includes adding an ultraviolet (UV) light absorbing compound to a sealing solution. The sealing solution suitable for sealing the pores of an anodic oxide. The UV light absorbing compound is configured to absorb at least a portion of UV wavelengths of light. The method also includes incorporating the UV light absorbing compound into the anodic oxide by exposing the anodic oxide to the sealing solution. During the exposing, the UV light absorbing compound becomes infused within a UV light absorbing seal layer. The UV light absorbing seal layer blocks UV light incident a top surface of the anodic oxide from reaching the colorant within the pores.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Representative applications of methods according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

The present application describes various methods of treating anodic oxides. In particular, various methods for improving the color retention of anodic oxides are described. In particular, reducing or eliminating color fading due to exposure to light is described. In a specific embodiment, methods include incorporating ultraviolet (UV) light absorbing compounds within anodic oxides to prevent color fading caused by exposure to UV light. The UV protected anodic oxides are well suited for providing protective and attractive surfaces to visible portions of consumer products. For example, methods described herein can be used for providing protective and cosmetically appealing exterior portions of metal enclosures and casings for electronic devices, such as those manufactured by Apple Inc., based in Cupertino, Calif.

Figure 1:
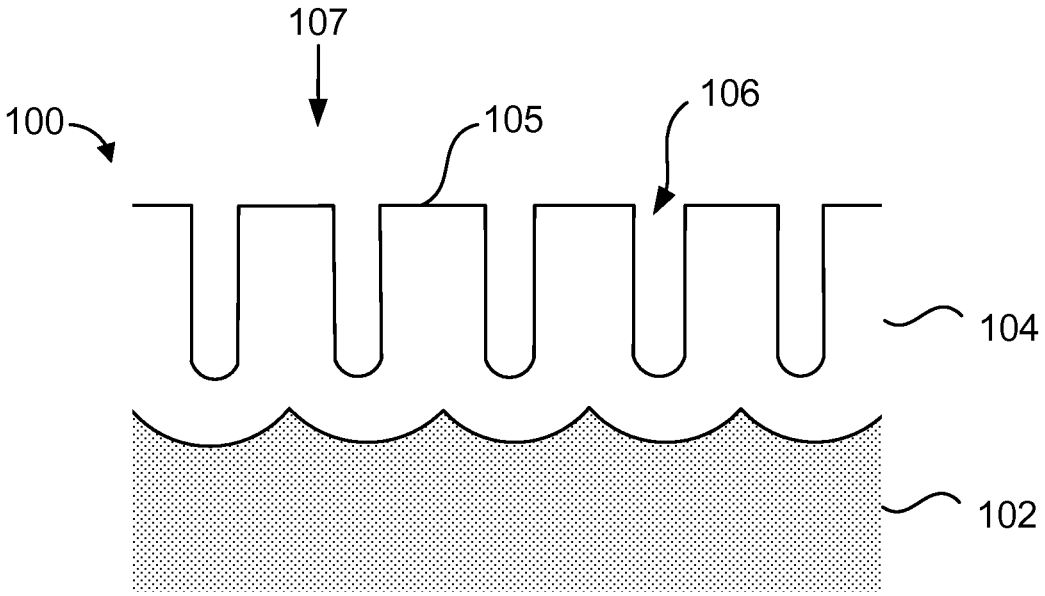
FIG. 1 shows a cross-section view of a part after undergoing an anodizing process showing an anodic oxide having anodic pores.

Anodizing is an electrolytic chemical process whereby at least a portion of a metal substrate is converted to a metal oxide finish, also referred to as an anodic oxide. During an anodizing process, nanometer scale voids, referred to as anodic pores, form within the anodic oxide. FIG. 1 shows a cross-section view of part 100 after undergoing an anodizing process. During the anodizing process, a portion of substrate 102 is converted to anodic oxide 104. As described herein, substrate 102 can be made of any suitable anodizable material. At least a portion of substrate 102 can be made of a metal material, including, but not limited to, aluminum, titanium, zinc, magnesium, niobium, zirconium, hafnium, and tantalum. The metal material can include a substantially pure metal material or be made of a metal alloy.

Anodic oxide 104 includes a matrix of metal oxide 105 that has a number of pores 106 formed therein. Each of pores 106 has a bottom portion positioned at the surface of the un-converted substrate 102 and a top portion positioned proximate to and open at top surface 107 of anodic oxide 104. In many cases, anodic oxide 104 can be substantially translucent in appearance in that most of the visible light incident top surface 107 of anodic oxide 104 is transmitted through anodic oxide 104 and reflect off of underlying un-converted substrate 102. Some visible light may reflect off of surfaces of anodic oxide 104, such as the pore walls of pores 106 or off of top surface 107, adding an opaque quality to anodic oxide 104. The amount of transparency of anodic oxide 104 can depend, in part, on the thickness of anodic oxide 104, with thicker anodic oxides being less transparent. In some cases, anodic oxide 104 can have an off-white or yellowish hue.

Figure 2:
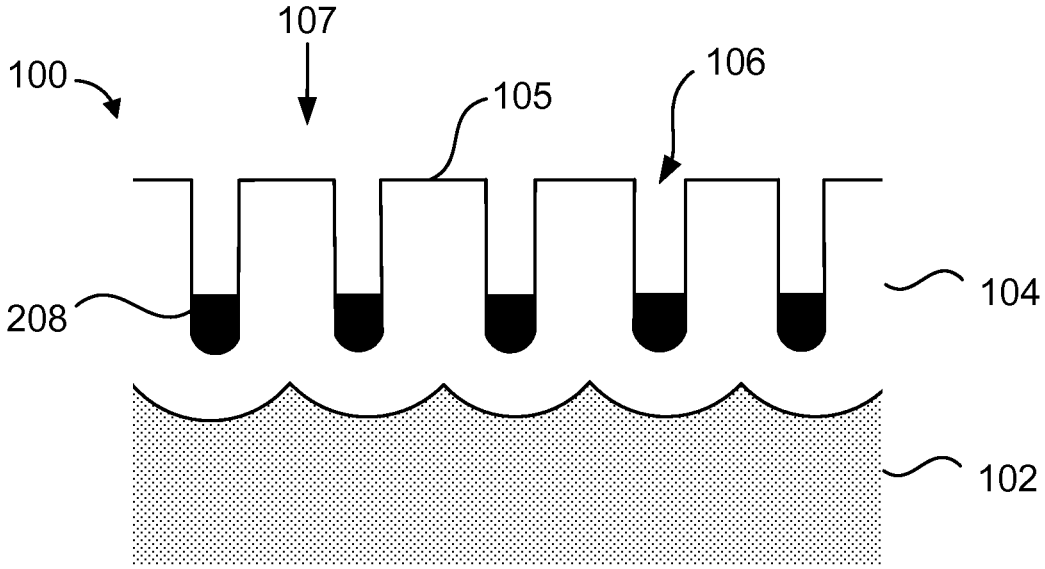
FIG. 2 shows an anodic oxide after a colorant is absorbed within anodic pores of the anodic oxide.

At FIG. 2, colorant 208 is absorbed within pores 106. Colorant 208 can include any suitable coloring agent such as one or more metallic materials, inorganic dyes, and organic dyes. In some embodiments, colorant 208 is situated at the bottom portions of pores 106, as shown in FIG. 2. In some embodiments, colorant 208 is situated at the top portion of pores 106, or substantially fills the entire volume of pores 106. When colorant 208 is inserted within pores 106, visible light entering top surface 107 of anodic oxide 104 can transmit through anodic oxide 104 and reach colorant 208 positioned within pores 106. Some of the visible wavelengths of light can be absorbed by colorant 208. The wavelengths of visible light that do not get absorbed by colorant 208 can reflect back through and exit anodic oxide 104 and will correspond to the color of anodic oxide 104. Thus, for example, if wavelengths corresponding to the color blue are reflected, anodic oxide 104 will take on a blue appearance. In some embodiments, colorant 208 absorbs substantially all wavelengths of visible light, imparting a black appearance to anodic oxide 104. In some cases, over time and exposure to ITV light, colorant 208 can degrade and lose its ability to absorb visible wavelengths of light. This is because UV light can break down chemical bonds within colorant 208. In effect, UV light bleaches and fades the color imparted to anodic oxide 104.

Methods described herein can be used to prevent or reduce the occurrence of color fading of anodic oxide 104 caused by exposure to UV light. The methods involve introducing UV light absorbing compounds within anodic oxide 104 such that the energy of incident UV light will be absorbed by the UV light absorbing compounds and not by colorant 208. That is, the UV light absorbing compounds can protect or block colorant 208 from exposure to at least a portion of incident UV light. The UV light absorbing compounds can be deposited within anodic oxide 104 by exposing anodic oxide 104 to a UV light absorbing compound mixed within a liquid or within a gas. For example, anodic oxide 104 can be exposed to a solution containing a UV light absorbing compound. The solution can be any type of solution, including aqueous or non-aqueous solutions. In some embodiments, the solution is also a sealing solution used for sealing the pores of anodic oxide 104 during a sealing process. In a sealing process, pores 106 are sealed in order to retain colorant 208 within pores 106 and also to increase the corrosion resistance of anodic oxide 104.

Figure 3A:
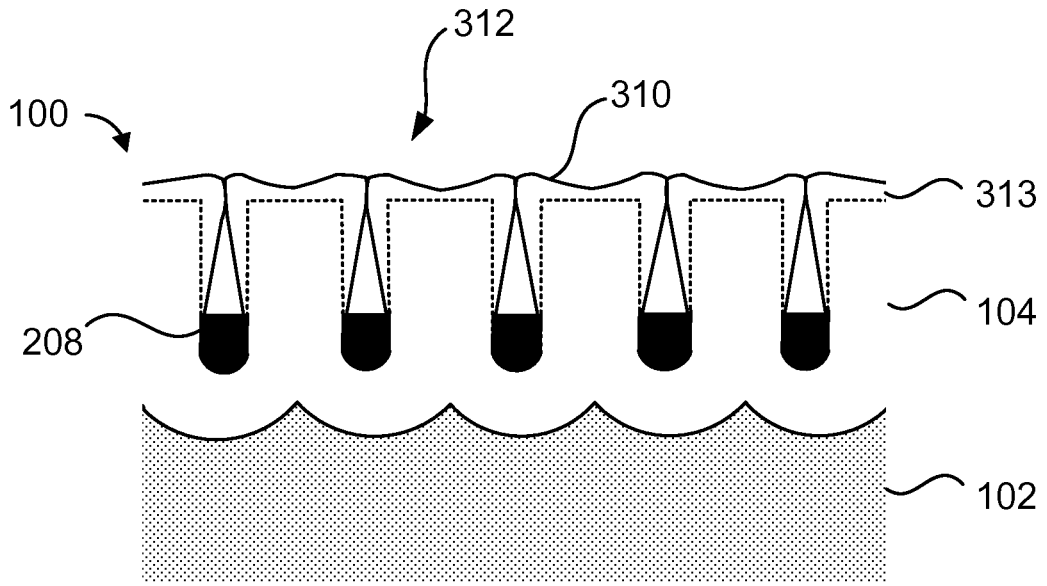
FIGS. 3A and 3B show a part after undergoing two different types of sealing processes, respectively.
Figure 3B:
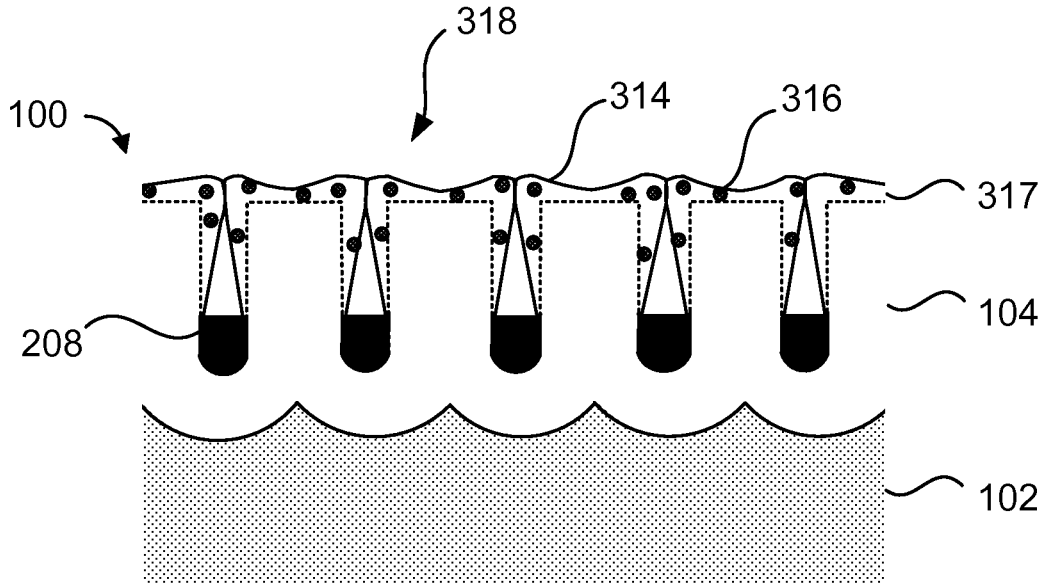

FIGS. 3A and 3B show part 100 after undergoing two different types of sealing processes, respectively. FIG. 3A shows part 100 after being exposed to a hot aqueous sealing process. A hot aqueous sealing process involves exposing anodic oxide 104 to an aqueous solution that dissolves exposed portions of metal oxide 105 to its metal oxide hydrate 310 form. The hydrating process dissolves and collapses the top portions of pores 106, forming a seal layer 313 at top surface 312. Seal layer 313 is denser than and enhances the corrosion resistance of the underlying portion of anodic oxide 104, providing anodic oxide a protective top surface 318. Seal layer 313 can also protect pores 106 from contaminants such as dirt, grease, and oil. In addition, colorant 208 becomes sealed within anodic oxide 104, preventing colorant 208 from leaching out of pores 106. Conversion of the metal oxide 105 to metal oxide hydrate 310 generally requires the sealing solution to be hot, e.g., 80 degrees C. or above. Other factors such as the pH of the sealing solution can also determine the degree to which the sealing process occurs. Exposing part 100 to a hot aqueous solution can include any suitable method, including immersing part 100 into a boiling-hot solution of aqueous solution or by exposing part 100 to steam.

FIG. 3B shows part 100 after being exposed to a variation of the hot water sealing process described above with reference to FIG. 3A. At FIG. 313, the sealing solution includes a sealant compound. As with the hot aqueous solution sealing process described above, exposed portions of metal oxide 105 are converted to its metal oxide hydrate 314, forming seal layer 317. The sealant compound is mixed into the aqueous sealing solution and generally contains a hydrolysable metal salt, such as a nickel salt (e.g., nickel acetate). The metal salt hydrolyzes and precipitates in the sealing solution as metal hydroxide 316. For example, a nickel salt will form a nickel hydroxide precipitate. During the sealing process, metal hydroxide 316 becomes absorbed and infused within metal oxide hydrate 314 within anodic oxide 104. The presence of metal hydroxide 316 within anodic oxide 104 can enhance the sealing ability of the seal layer 317 and better prevent leaching out of colorant 208 from pores 106. The presence of metal hydroxide 316 within seal layer 317 can also make top surface 318 more chemically inert.

Figure 4A:
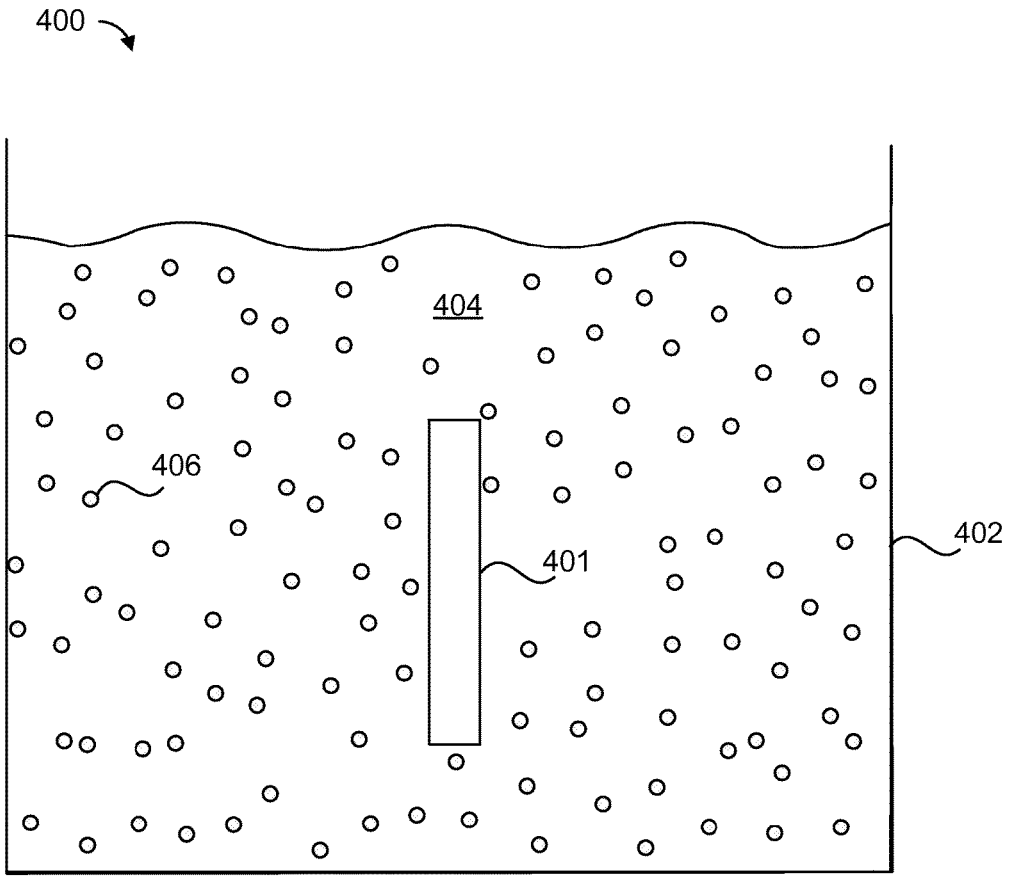
FIG. 4A shows an apparatus used to introduce UV light absorbing compounds into an anodic oxide during a sealing process.

In order to deposit a UV light absorbing compound within pores 106, the light absorbing compound can be introduced during a sealing process, such as described above with reference to FIGS. 3A and 3B. FIG. 4A shows apparatus 400 used to introduce UV light absorbing compounds during a sealing process, in accordance with described embodiments. Apparatus 400 includes tank 402, which is configured to hold sealing solution 404 and part 401. Sealing solution 404 is an aqueous solution that has UV light absorbing compound 406 mixed therein. Sealing solution 404 can be heated so as to promote the pore sealing process described above with reference to FIGS. 3A and 3B. Light absorbing compound 406 can be any compound or mix of compounds capable of absorbing at least a portion of UV wavelengths of light. In some embodiments, UV light absorbing compound 406 includes para-aminobenzoic acid, also known as PABA. Provided below is a chemical structure of PABA.

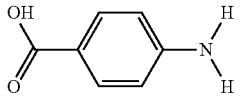

As shown above, PABA has resonance bonds within its benzene ring and its carboxyl group. These resonance bonds can capture energy corresponding to UV wavelengths of light and dissipate the energy as heat. Because of its UV light absorbing ability, PABA has widely been used as an agent in sunscreen. Alternative UV light absorbing compounds, such as other compounds having resonance structures, can also be used. Examples of other suitable UV light absorbing compounds can include, but are not limited to, benzophenone, benzotriazole, and hindered amine compounds. In some embodiments, more than one type of UV light absorbing compound is used. The choice of UV light absorbing compound 406 can depend on a number of factors, such as how miscible the compound is in aqueous sealing solution 404. In some embodiments, another agent can be included within sealing solution 404 to make UV light absorbing compound 406 more miscible. For example, a surfactant or a dispersant agent can be used. In some embodiments, UV light absorbing compound 406 is completely dissolved in sealing solution 404. In other embodiments, UV light absorbing compound 406 is only partially dissolved in sealing solution 404 and allowed to exist in colloidal form. In some embodiments, sealing solution 404 is continually agitated in order to keep UV light absorbing compound 406 suspended with sealing solution 404. PABA, particular, is slightly soluble in aqueous solution and can therefore be at least partially dissolved within sealing solution 404. Another consideration for choosing an appropriate type of UV light absorbing compound can be its transparency to visible wavelengths of light. This consideration will be described in detail below.

Figure 4B:
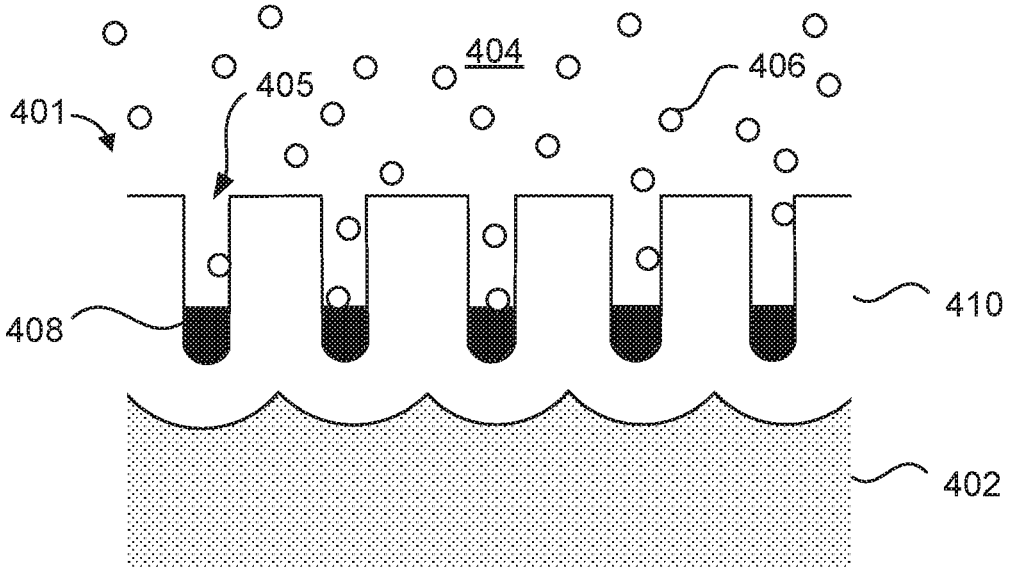
FIGS. 4B and 4C show close-up cross-section views of a part undergoing a. sealing process including a UV light absorbing compound.
Figure 4C:
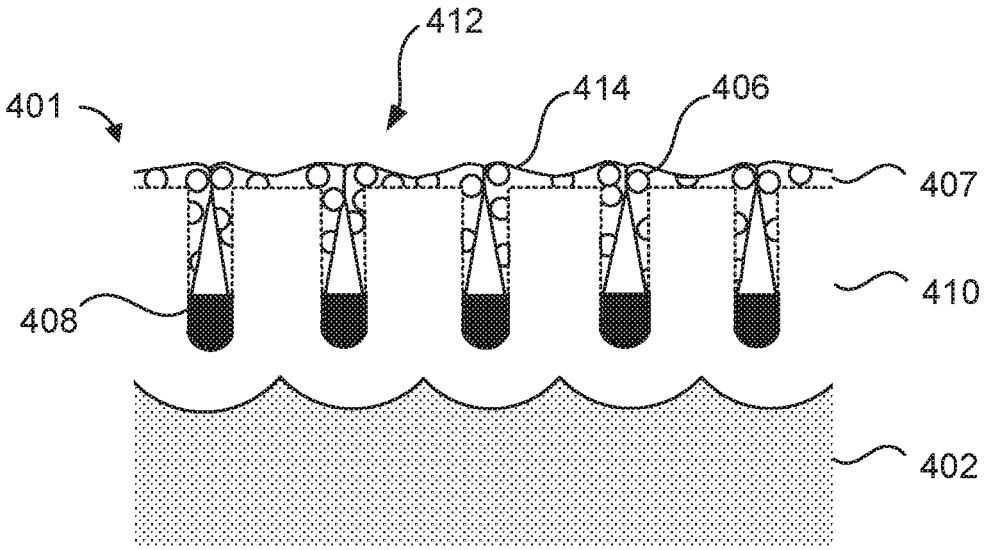

During the pore seating process, UV light absorbing compound 406 will become deposited within the seal of anodic oxide 410 on part 401. FIGS. 4B and 4C show close-up cross-section views of a portion of part 401, which has anodic oxide 410 disposed over substrate 402, during a sealing process. FIG. 4B shows anodic oxide 410 being exposed to sealing solution 404 having UV light absorbing compound 406 mixed therein. Pores 405 of anodic oxide 410 have colorant 408 deposited therein. As shown, UV light absorbing compound 406 is allowed to at least partially diffuse within pores 405 during the sealing process. In some embodiments, UV tight absorbing compound 406 and colorant 408 are chosen such that they do not chemically react during the sealing process. In other embodiments, UV light absorbing compound 406 is chosen such that it can chemically react with colorant 408 and modify or enhance the light absorbing properties of colorant 408.

FIG. 4C shows part 401 after the sealing process is complete. As shown, exposed portions of the metal oxide of anodic oxide 410 are converted to metal oxide hydrate 414, forming seal layer 407. Seal layer 407 seals in colorant 208 within pores 405. UV light absorbing compound 406 can be incorporated within the metal oxide material of seal layer 407, which substantially entirely covers top surface 412 of anodic oxide 410. Note that in some embodiments a portion of UV light absorbing compound 406 can remain within pores 405. Since UV light absorbing compound 406 absorbs UV light incident top surface 412, underlying colorant 408 is protected from exposure to UV light. That is, seal layer 407 acts as a UV blocking layer that absorbs incident UV light. As described above, one factor that can be taken into consideration regarding choosing a type of UV light absorbing compound 406 is its transparency to visible light. In some embodiments, UV light absorbing compound 406 is substantially transparent or translucent to visible wavelengths of light entering top surface 412 so that the visible light can reach and be absorbed by colorant 408 giving anodic oxide 410 a corresponding color. In other embodiments, UV light absorbing compound 406 absorbs at least a portion of visible wavelengths of light and contributes to the final color of anodic oxide 410. In some embodiments, it can be desirable to perform a second sealing process, whereby part 401 is exposed to a second sealing solution. In some embodiments, the second sealing solution does not include UV light absorbing compound 406, thereby forming a second sealing layer on the top of anodic oxide 410 that does not include UV light absorbing compound 406.

Figure 5A:
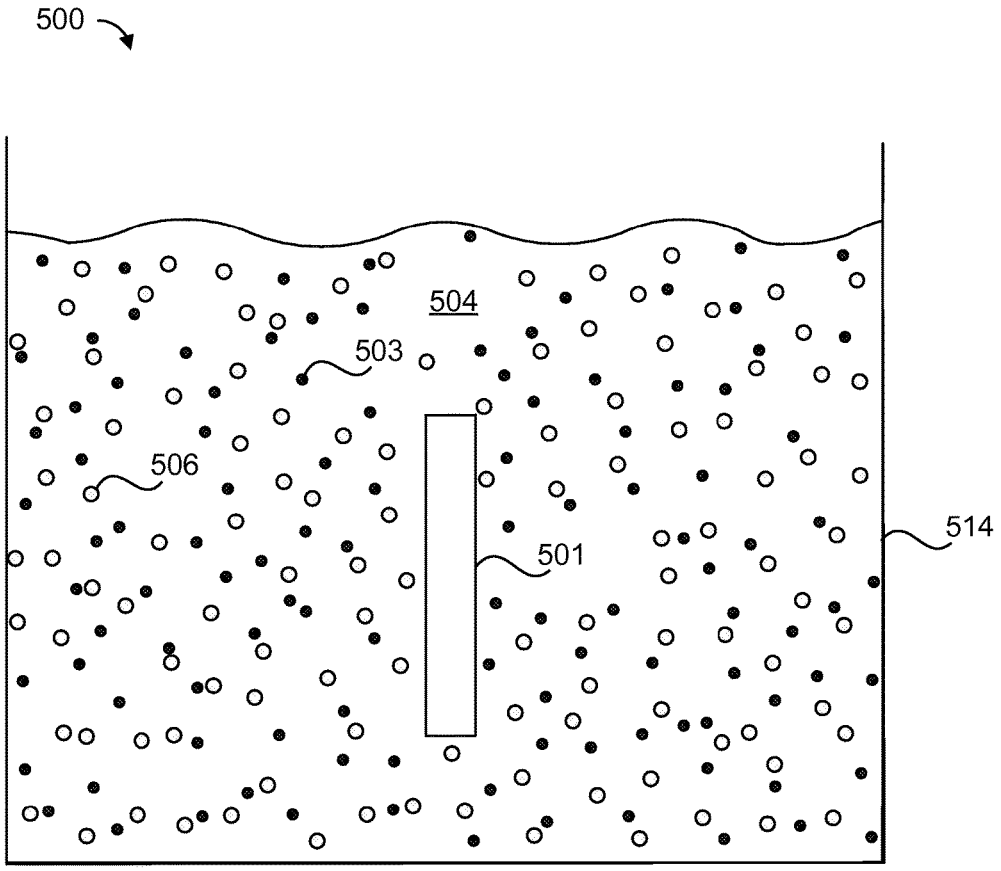
FIG. 5A shows an apparatus used to introduce UV light absorbing compounds into an anodic oxide during a sealing process that includes a sealant compound.
Figure 5B:
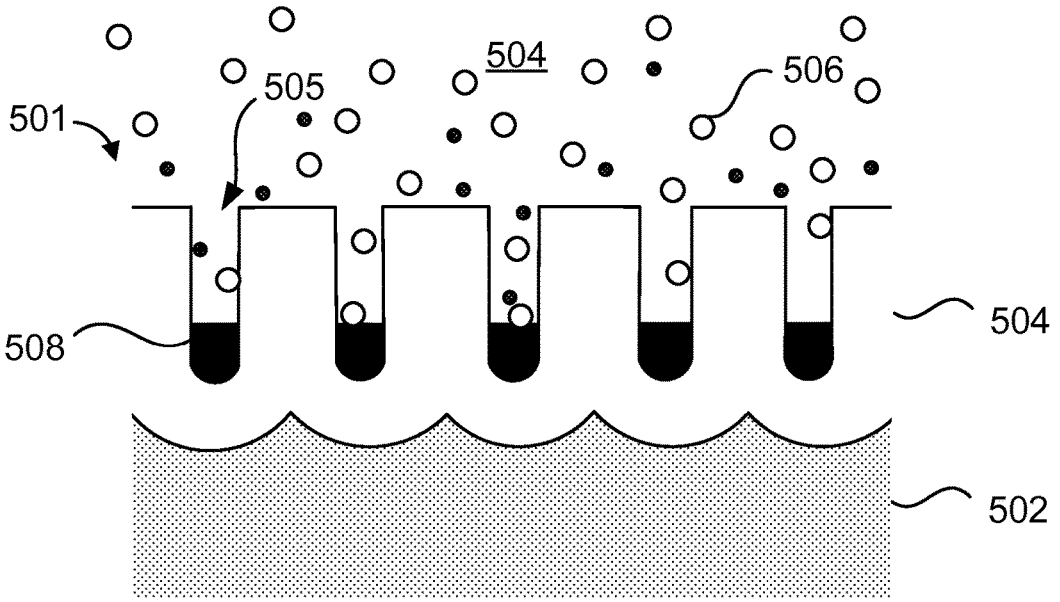
FIGS. 5B-5D show close-up cross-section views of a part undergoing a sealing process including a sealant compound and a UV light absorbing compound.

FIG. 5A shows apparatus 500 of another embodiment used to introduce UV light absorbing compounds during a sealing process, in accordance with described embodiments. Apparatus 500 includes tank 514, which is configured to hold sealing solution 504 and part 500. Sealing solution 504 has UV light absorbing compound 506 and metal hydroxide 503 mixed therein. Metal hydroxide 503 is formed by the exposure of the anodic finish (oxide) and reaction with a metal salt in the aqueous sealing solution 504. The metal salt precipitates in solution 504 as metal hydroxide 503, as described above with reference to FIG. 3B. Light absorbing compound 506 can be any compound or mix of compounds capable of absorbing at least a portion of UV wavelengths of light, such as PABA. In some embodiments, UV light absorbing compound 506 is chosen such that it does not react with metal hydroxide 503 or its metal salt. FIG. 5B shows a close-up cross-section view of part 501 showing anodic oxide 504, which is positioned on substrate 502, exposed to sealing solution 504 during a sealing process. Sealing solution has UV light absorbing compound 506 and metal hydroxide 503 mixed therein. During the sealing process, UV light absorbing compound 506 and metal hydroxide 503 are allowed to diffuse within pores 505.

Figure 5C:
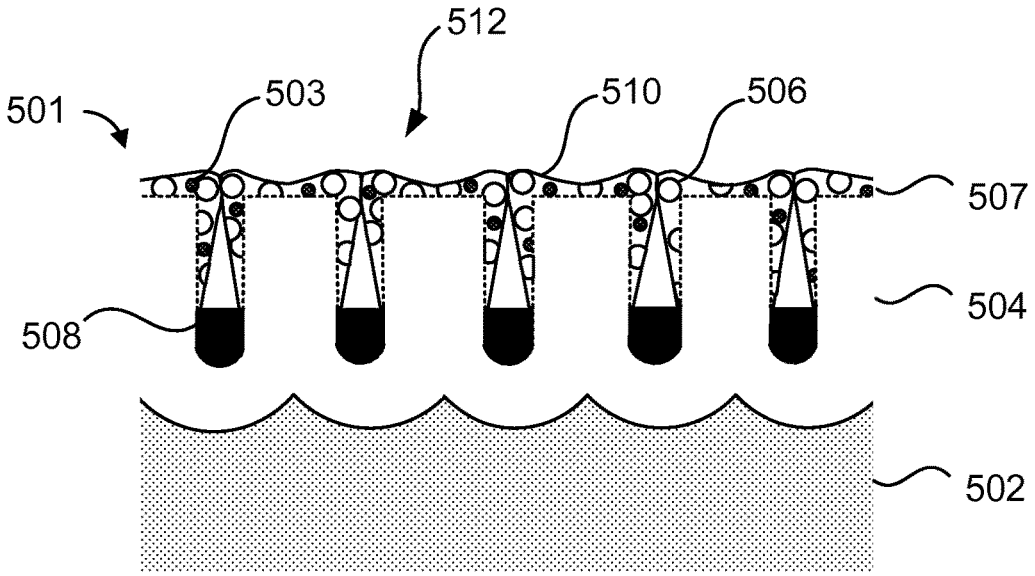

FIG. 5C shows part 501 after the sealing process is complete. As shown, the exposed portions of the metal oxide of anodic oxide 504 are converted to metal oxide hydrate, forming seal layer 507. Seal layer 507 seals colorant 508 within pores 505. UV light absorbing compound 506 and metal hydroxide 503 are incorporated within seal layer 507. Metal hydroxide 503 can enhance the quality of the seal and prevent or reduce leaching out of colorant 508 from pores 505. UV light absorbing compound 506 can absorb UV light incident top surface 512 of anodic oxide 504 and prevent or reduce UV light from reaching colorant 508.

Figure 5D:
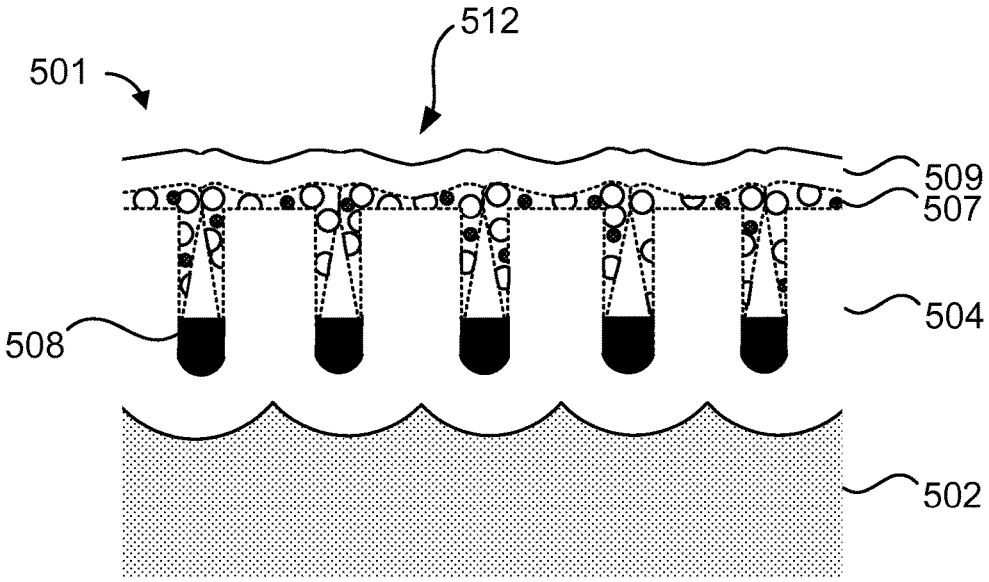

As described above, in some embodiments, a second sealing process is performed. FIG. 5D shows part 501 after an optional second sealing process, whereby part 501 is exposed to a second sealing solution that does not include UV light absorbing compound 506. The second sealing process forms second seal layer 509 over seal layer 507. In some embodiments, second seal layer 509 can prevent UV light absorbing compound 506 from leaching out of seal layer 507, which can reduce the UV blocking ability of seal layer 507. In some embodiments, second seal layer 509 includes metal hydroxide 503. In some embodiments, second seal layer 509 does not include metal hydroxide 503.

Figure 6:
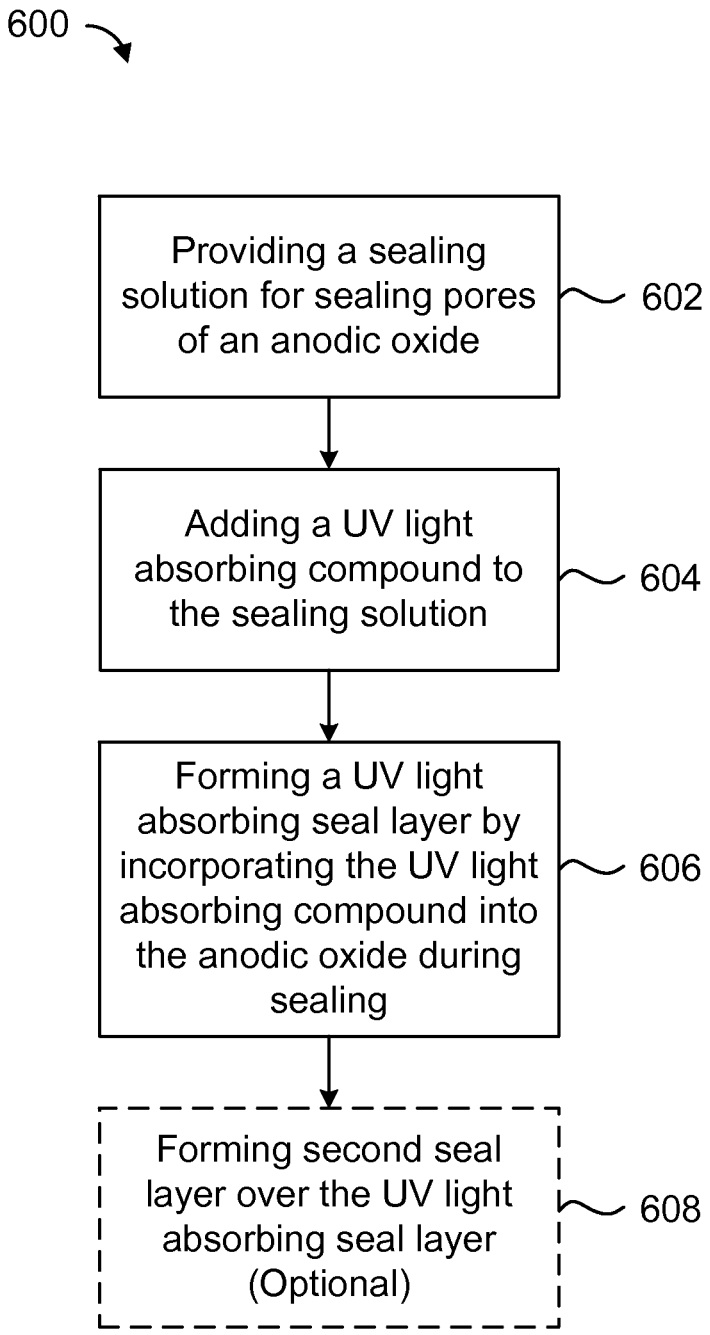
FIG. 6 shows a flowchart indicating a process for incorporating UV absorbing compound into anodic oxide.

FIG. 6 shows flowchart 600 indicating a process for incorporating UV absorbing compound into anodic oxide. At 602, a sealing solution for sealing pores of an anodic oxide is provided. in some embodiments, the sealing solution includes a sealant compound, such as a metal hydroxide, that improves the quality of the sealing. At 604, a UV light absorbing compound is added to the sealing solution. The UV light absorbing compound can be any suitable compound capable of absorbing at least a portion of UV light wavelengths. In some embodiments, more than one type of UV light absorbing compound is used. At 606, a UV light absorbing seal layer is formed by incorporating the UV light absorbing compound into the anodic oxide during a sealing process. In some embodiments, this involves immersing the anodic oxide into a sealing solution bath that has the UV light absorbing compound mixed therein. The UV light absorbing compound can become incorporated with the metal oxide hydrate formed during the sealing process. The UV light absorbing seal layer can block UV light from reaching any underlying colorant existing within the pores of the anodic oxide and decrease the occurrence of color fading. At 608, an optional second seal layer is formed over the UV light absorbing seal layer. The second seal layer can be formed by exposing the anodic oxide to a second sealing solution that does not include a UV light absorbing compound. The second seal layer can prevent leaching out of the UV light absorbing compound from the UV light absorbing seal layer.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method of forming a part having a color fade resistant anodic oxide disposed over a substrate, the method comprising:

depositing a colorant within pores of the color fade resistant anodic oxide;

forming a first seal layer having an ultraviolet (UV) light absorbing compound incorporated within a metal oxide hydrate of the first seal layer, wherein the UV light absorbing compound comprises at least one of a para-aminobenzoic acid (PABA), a benzophenone, a benzotriazole, or a hindered amine compound; and forming a second seal layer positioned on the first seal layer, wherein the second seal layer is free of the UV light absorbing compound.

2. The method as recited in claim 1, wherein the second seal layer has an external surface corresponding to an external surface of the color fade resistant anodic oxide.

3. The method as recited in claim 1, wherein the metal oxide hydrate has a nickel hydroxide precipitate incorporated therein.

4. The method as recited in claim 1, wherein forming the second seal layer comprises exposing the anodic oxide to a solution comprising a metal salt.

5. The method as recited in claim 4, wherein a metal hydroxide precipitate of the metal salt becomes infused within the second seal layer.

6. The method as recited in claim 1, wherein the UV light absorbing compound is substantially transparent to visible wavelengths of light.

7. The method as recited in claim 1, wherein the UV light absorbing compound does not substantially chemically react with the colorant.

8. The method as recited in claim 1, wherein the UV light absorbing compound modifies light absorbing properties of the colorant.

9. The method as recited in claim 1, wherein the UV light absorbing compound comprises para-aminobenzoic acid (PABA).

10. A part having a color fade resistant anodic oxide disposed over a substrate, the color fade resistant anodic oxide comprising:

a colorant deposited within pores of the color fade resistant anodic oxide;

a first seal layer having an ultraviolet (UV) light absorbing compound incorporated within a metal oxide hydrate of the first seal layer, wherein the UV light absorbing compound comprises at least one of a para-aminobenzoic acid (PABA), a benzophenone, a benzotriazole, or a hindered amine compound; and a second seal layer positioned on the first seal layer, wherein the second seal layer is free of the UV light absorbing compound.

11. The part as recited in claim 10, wherein the second seal layer has an exterior surface corresponding to an exterior surface of the part, wherein the at least a portion of the UV light absorbing compound is positioned more proximate to the exterior surface than the colorant, thereby blocking at least a portion of UV wavelengths of light incident the exterior surface from reaching the colorant.

12. The part as recited in claim 10, wherein the UV light absorbing compound modifies light absorbing properties of the colorant.

13. The part as recited in claim 10, wherein the metal oxide hydrate has a nickel hydroxide precipitate incorporated therein.

* * * * *